United States Patent [19]

Curtis et al.

[11] Patent Number: 4,615,163

[45] Date of Patent: Oct. 7, 1986

[54] REINFORCED LUMBER

[76] Inventors: Albert B. Curtis, 2375 Dellwood Ave., Lake Oswego, Oreg. 97034; J. Kenneth Brody, 2763 SW. Summit Dr., Portland, Oreg. 97201

[21] Appl. No.: 657,742

[22] Filed: Oct. 4, 1984

[51] Int. Cl.[4] ..... E04C 3/30

[52] U.S. Cl. ..... 52/730; 52/821; 52/309.13

[58] Field of Search ..... 52/727, 730, 821, 829, 52/827, 828, 368, 376, 309.13, 309.14; 428/192

[56] References Cited

U.S. PATENT DOCUMENTS

| | | | |
|---|---|---|---|
| 1,084,276 | 1/1914 | Jaminet | 52/821 X |
| 1,673,565 | 6/1928 | Heath | 52/821 X |
| 2,851,747 | 9/1958 | Rolen | 52/376 X |
| 3,077,012 | 2/1963 | Speraw | 52/309.13 X |
| 3,251,162 | 5/1966 | Strimple . | |
| 3,294,608 | 12/1966 | Peterson . | |
| 3,533,203 | 10/1970 | Fischer et al. . | |
| 3,717,886 | 2/1973 | Watts . | |
| 3,890,077 | 6/1975 | Holman . | |
| 3,893,273 | 7/1975 | Sailor . | |
| 4,275,537 | 6/1981 | Pinson . | |
| 4,312,162 | 1/1982 | Medney . | |
| 4,443,990 | 4/1984 | Johnson | 52/730 X |

*Primary Examiner*—Carl D. Friedman

*Attorney, Agent, or Firm*—Klarquist, Sparkman, Campbell, Leigh & Whinston

[57] ABSTRACT

A wooden beam is reinforced with a polyester rod glued within groove on surface to increase the ultimate strength of the beam under stress and reduce deviation of strength between beams.

13 Claims, 11 Drawing Figures

FIG. 9
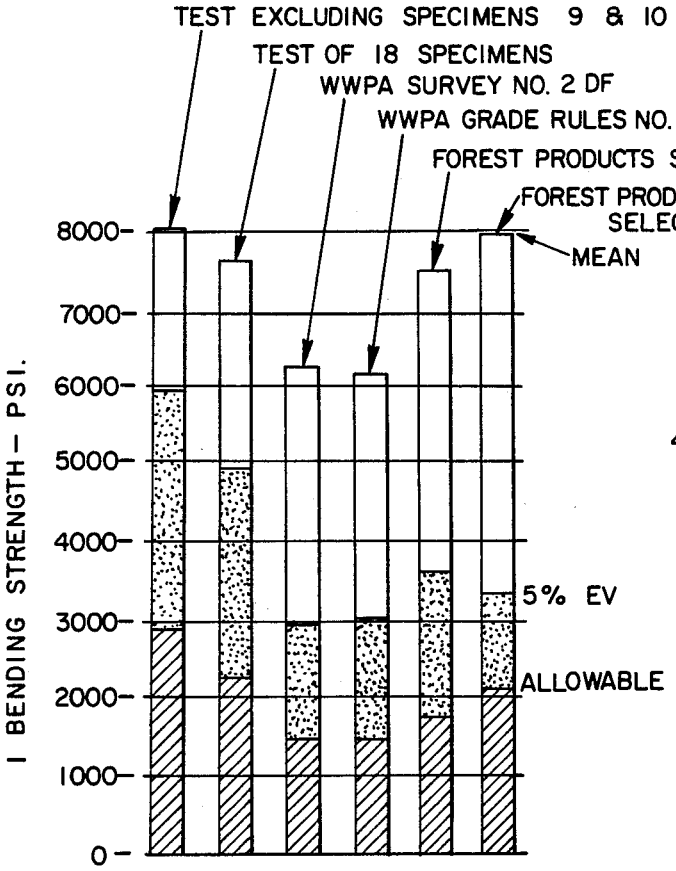
BAR GRAPH SHOWING RESULTS TABULATED IN TABLE II
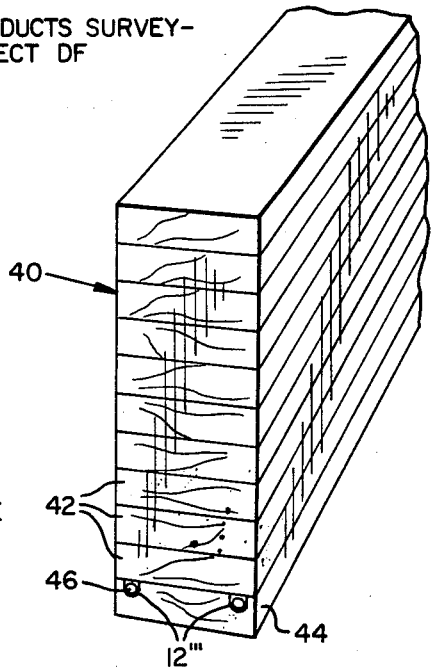
FIG. 10
FIG. 11
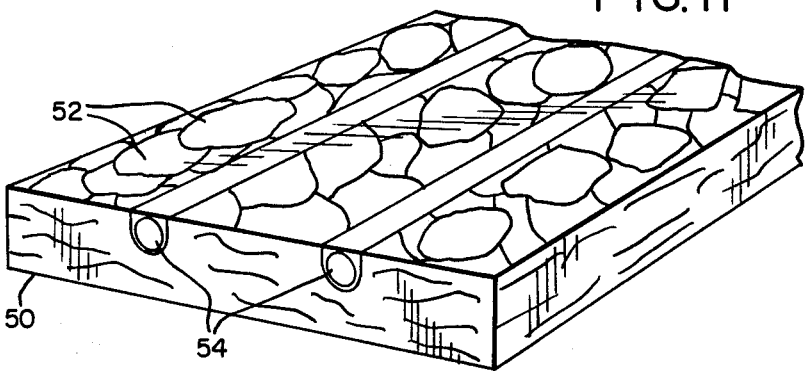

REINFORCED LUMBER

FIELD OF THE INVENTION

This invention relates to reinforced structural members and, more particularly, to beams of wood or wood-constructed products reinforced with permanently affixed glass fiber-polyester rods.

BACKGROUND OF THE INVENTION

While wood has many desirable qualities that make is useful for structural members, use of sawn lumber for structural members also creates several difficulties because of some inherent problems. First of all, wood timbers are inherently nonuniform in their structural characteristics. The presence of knots and the location thereof from one structural member to another can cause great variation in the structural strength of a member. The location of the wood of a structural member within a tree can cause a variation in its characteristics from a member that is taken from a different portion of the tree. Moreover, high grade structural quality wood timbers are becoming increasingly more expensive as the supply of old growth, virgin trees nears exhaustion. The second growth trees from which more and more lumber is originating tend to have more knots and other defects which makes it less suitable for structural purposes.

Because of the wide disparity in the strength of wooden structural members, several difficulties in the use of such members are created. First, the structural members must be carefully graded, and any members that have apparent weakening defects must be rejected or downgraded which, of course, decreases their commercial value substantially. Second, because of the increasing scarcity of high grade wood structural members, they are becoming increasingly more expensive. Moreover, because of the wide variation in structural strength existent even within a carefully graded lot of wooden structural members, in order to ensure an adequate safety margin, larger members or an increased number of members have to be specified than would be the case if the structural strength fell within a narrower range.

Previous attempts to increase the strength of wooden structural support members have been made. For example, U.S. Pat. No. 3,717,886 discloses a bed frame with reinforced slats consisting of a flat, rolled steel reinforcing member attached to the bottom face of a wooden slat member. In U.S. Pat. No. 3,294,608 a wood beam is prestressed and a steel plate bonded to the surface under tension. However, although suitable for use in small scale applications, such systems could not function economically under large-scale construction conditions. Besides the high cost of manufacture and the additional weight, such composites would present fastening problems and are not adapted to be cut to shorter lengths with the usual wood-working equipment. Likewise, prestressed elements have been used to reinforce structural members. For example, U.S. Pat. No. 3,533,203 discloses the use of stretched synthetic ropes to apply a compressive force to such diverse items as concrete beams, aluminum pipe and ladder rails, the stretched element being attached by clamps or similar means to the member. U.S. Pat. No. 3,890,097 discloses the manufacture of fiber board wherein fiberglass strands are embedded in the matrix as the board is laid up and held under tension until the resin has set and in U.S. Pat. No. 4,312,162 tension is applied to steel or fiberglass strands laid up along the side of a fiberglass light pole until a resin matrix sets to bind the strands of the pole.

In U.S. Pat. No. 3,251,162 a series of rods or cables pass through a laminated beam and are connected to tensioning plates and bolts at either end. Similarly, in U.S. Pat. No. 3,893,273, a vertical rod tensioned at either end is set in the edge of a door. U.S. Pat. No. 4,275,537 discloses a whole series of truss assemblies composed in each case of multiple parts, in which the basic principle is the use of pre-stressed or pre-loaded elements, such as tensioned cables or steel straps to accomplish reinforcement.

These prior procedures and products each have inherent disadvantages. The disadvantage of steel and like reinforcing material has already been discussed. The manufacture of products where one or more elements must be held under tension is inherently expensive. In constructions of multiple parts, a total product is produced, such as a ladder, a door or a truss which must be used as a whole. Thus, none of the patents cited permit easy cutting to size at the job site to suit the needs of the job.

SUMMARY OF THE INVENTION

It is a principal object of the present invention to provide a structurally reinforced wooden beam member designed to overcome inherent weaknesses resulting from natural wood defects and that can be manufactured economically.

An object of the invention is to produce reinforced lumber of significantly enhanced structural strength, uniformity and utility which can be handled at the job site exactly as ordinary lumber.

Another important object of the present invention is to provide wooden beams with structural reinforcements that do not require prestressing techniques in their manufacture.

More particularly, it is an object to provide a wooden beam member reinforced with one or more fiberglass/resin rods adjacent a longitudinal surface of the beam whereby the ultimate strength of the beam is substantially increased.

Another object of the invention is to provide a method of reinforcing wooden beam members whereby a lot of such members will have less disparity in the range of ultimate strength of such members.

It is another object of this invention to provide reinforced wooden beam members having long-lasting resistance to aging and natural weakening processes.

It is a further object of the present invention to provide wooden beam members structurally reinforced with glass fiber-resin rods.

It is a still further object of this invention to provide reinforced wooden beam members which maintain high levels of tensional strength when cut into shorter lengths.

Other objects and features of the present invention will become apparent hereinafter.

In accordance with the illustrated embodiment of the invention, a wooden beam member is provided with one or more grooves adjacent a surface which will be in tension under load. In each of these grooves is placed a preformed glass fiber-resin rod preferably of equal length as the wooden beam member. The rod is securely affixed to the beam within a groove, using a resin-based adhesive material. A beam reinforced in such manner exhibits a substantial increase in ultimate strength as compared to non-reinforced wood beams and reinforced beams exhibit much less variation in their strength. Moreover, shortening of the beam by cutting off a portion does not destroy the beneficial effect of the reinforcement on the remaining length of the beam.

For a more detailed description of the invention, reference is made to the accompanying drawings and following description of the invention.

BRIEF DESCRIPTION OF THE DRAWINGS

FIG. 9 is a bar graph illustrating certain features of the invention.

FIG. 10 is a view of a laminated beam illustrating how reinforcing members may be incorporated therein; and FIG. 11 is a view of a plank formed of wood flakes incorporating reinforcing members in accordance with the invention.

DETAILED DESCRIPTION

Figure 1:
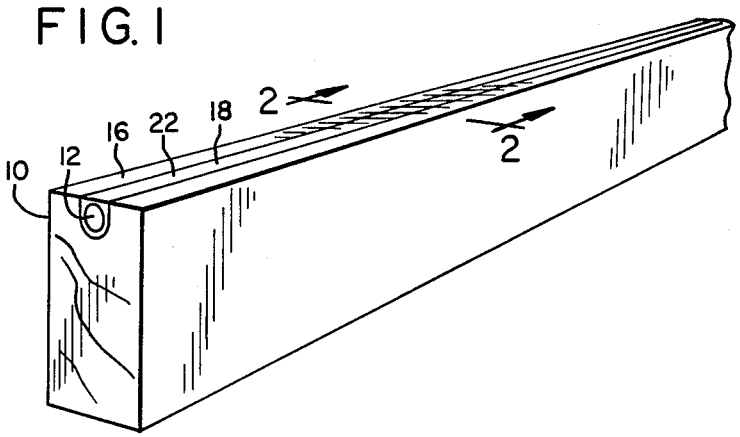
FIG. 1 is a perspective view of a reinforced wooden member made in accordance with the invention.
Figure 2:
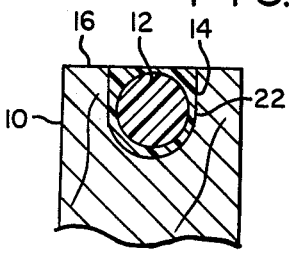
FIG. 2 is an enlarged cross-sectional view taken along line 2—2 of FIG. 1.

Referring first to FIG. 1, a wood beam 10 is illustrated having an unstressed circular glass fiber reinforced polyester rod 12 positioned in a round bottomed groove 14 formed in a surface 16 of the beam member. While the invention is generally applicable to wood beams sawn directly from logs and will be particularly described with respect to such sawn beams, the reinforcing system herein described is also applicable to beams formed by laminating smaller boards and to structural members formed of wood flakes bonded with a suitable resin. "Wood beams" herein embraces all of these. The rod 12 preferably extends longitudinally for the entire length of the beam 10, as illustrated, but may for some purposes be of shorter length. As shown in FIG. 2, the groove 14 is of such depth that the uppermost surface 18 of the rod 12 is substantially flush with the beam surface 16. The reinforcement rod 12 is permanently affixed in groove 14 with a resin-based adhesive 22, e.g., ATACS Products, Inc. K114-A/B, an epoxy-type resin. Prior to application of the adhesive, the surface of rod 12 may be abraded, if necessary, to facilitate adherence of the adhesive. To assure good and complete adhesion, the surface of the groove 14 and the rod 12 are both coated with the adhesive before the rod 12 is inserted. The groove 14 is preferably formed with a curved bottom surface complementary to rod 12, the width and depth of the groove being such as to admit the rod with a clearance substantially equal to the preferred glue line thickness, i.e., about 0.007".

Figure 3:
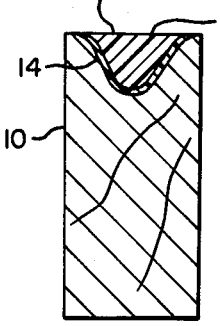
FIGS. 3 and 4 are fragmentary perspective views of further modifications of the present invention.
Figure 4:
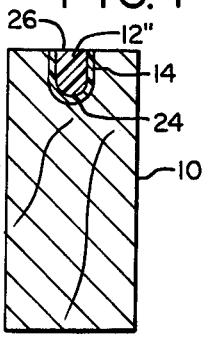

As shown in FIGS. 3 and 4, the cross-sectional shape of the embedded rod may be selectively varied. For example, FIG. 3 illustrates a beam having a generally triangular rod 12' embedded therein, the rod being positioned with a rounded bottom side down and a flat side 25, extending parallel to and flush with the beam surface, with groove 14' being shaped to complement rod 12'. FIG. 4 shows a beam having a rod 12" in a so-called "bull nose" configuration having a semicircular embedded edge 24 and a flat top surface 26 parallel with the beam surface. The groove 14" is shaped to conform to the rod 12".

Figure 5:
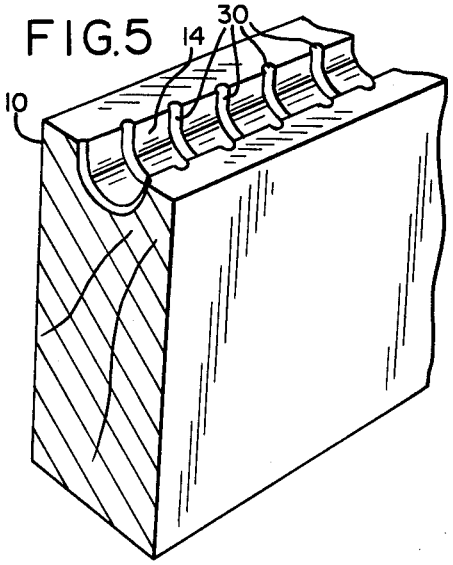
FIG. 5 is a perspective view of a wooden beam member showing a groove with notches designed to facilitate contact between said groove surfaces and resin adhesive.
Figure 6:
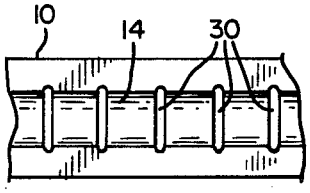
FIG. 6 is a plan view of the notched groove embodiment as shown in FIG. 5.
Figure 7:
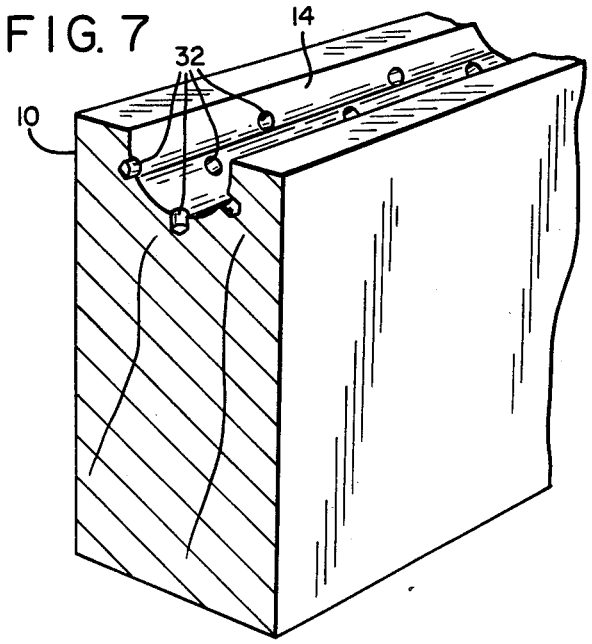
FIG. 7 is a perspective view of the wooden beam member showing a groove with holes designed to facilitate contact between said groove surfaces and resin adhesive.
Figure 8:
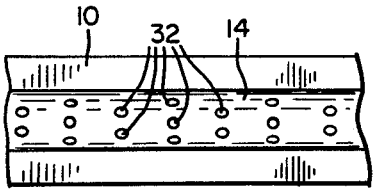
FIG. 8 is a plan view of the embodiment shown in FIG. 7.

Physical modifications of the groove in some instances facilitate adhesion between the rod 12 and groove 14 surface. For example, as shown in FIGS. 5 and 6, transversely extending notches 30 may be formed in the groove 14 walls and bottom. Similarly, as shown in FIGS. 7 and 8, a plurality of holes 32 may be drilled or punched in the bottom of groove 14. The grooves and/or holes effect greater adhesion between the beam 10 and rod 12 by keying the cured resin to the wood thus reducing the likelihood of any longitudinal shifting between the beam and rod when the beam is bent under load.

Illustrated in FIG. 10 is a beam 40 formed by laminating smaller wood sections 42 in the conventional manner. However, in accordance with the invention the laminating layer 44 near one edge of the beam is formed with one or more grooves 46, two being illustrated, in each of which a fiberglass rod 12''' is glued.

FIG. 11 illustrates a flake board plank 50 formed by laying up wood flakes indicated at 52 with a bonding resin and compressing the mass while resin sets in the usual manner. One face of the plank 50 is formed with a pair of grooves in which are bonded fiberglass rods 54. Flake board products are notably weak in tensile strength and the presence of reinforcing rods 54 will enhance the tensile strength of the face in which they are embedded thereby enlarging the utility of such products.

EXAMPLE I

A load test conducted on members constructed in accordance with the invention disclosed herein provides evidence of its value and effectiveness. Eighteen eight-foot long 2×4's of mill-run No. 2 grade Douglas fir selected at random from a shipment of 156 pieces were each provided a lengthwise-extending 17/64" wide, round bottomed groove in one edge thereof. Bonded in the grooves were ¼" diameter rods of a pultruded type consisting of 70–75% glass fiber, combined with polyester resin binders. The surface of each groove and rod was coated with an epoxy resin before placement of the rods in the grooves. The surface of each rod was abraded to facilitate adhesion of the resin. The resin adhesive used was an epoxy resin manufactured by the Fiber Resin Corporation.

Each reinforced 2×4 was tested on a 90-inch span, the 2×4's being positioned with the reinforced edge facing downwardly. Test loads were positioned at third points on the reinforced 2×4's. The load rate for the tests was 0.5 inches per minute in accordance with ASTM Standard D198. Upon structural failure of each 2×4, the load involved was measured and recorded. The moisture content of the specimens varied from 10 to 14 percent, averaging about 12 percent. The specific gravity of the specimens averaged 0.44 and ranged from 0.39 to 0.52, oven dry weight and green volume basis.

Table I shows the ultimate bending strength for each of the eighteen reinforced specimens.

TABLE I

| Ultimate Bending Strength of Reinforced No. 2 Douglas Fir 2 × 4's | |
|---|---|
| Specimen No. | UBS-(psi) |
| 1 | 9902 |
| 2 | 7353 |
| 3 | 6618 |
| 4 | 9118 |
| 5 | 9314 |
| 6 | 6961 |
| 7 | 9069 |
| 8 | 8579 |
| 9 | 4559 |
| 10 | 4215 |
| 11 | 8676 |
| 12 | 7640 |
| 13 | 5980 |
| 14 | 9607 |
| 15 | 7255 |
| 16 | 7848 |
| 17 | 6813 |
| 18 | 7647 |
| Mean = | 7620 |

Thereafter, the methods of analysis as indicated in ASTM D2555 and parts of ASTM D2915 were used to analyze the data received. This procedure of analysis uses elementary statistical theory based on the ordinary Student's "t". This theory estimates that the upper and lower boundaries of 90 percent of a normal distribution of the population from which an 18 specimen sample is randomly chosen are equal to the mean plus or minus 1.74 times the standard deviation.

The standard deviation, computed from the 18 piece sample is the square root of the sum of the squares of the individual test values' deviation from their mean. The mean is denoted $\overline{X}$, and the standard deviation is denoted as s. "t" is a statistical quantity for estimating the boundaries and it varies with the size of the sample, and the percentage of the population included within the limits.

No. 2 grade softwood lumber has a reasonably normal symmetrical distribution about the mean. Thus, the boundaries are:

$$\text{Upper limit} = \overline{X} + ts = 7620 + 1.74\,(1616) = 10{,}431 \text{ psi}$$

$$\text{Lower limit} = \overline{X} - ts = 7620 - 1.74\,(1616) = 4{,}808 \text{ psi}$$

This lower limit exceeds the lowest 5% of the strength values of this population since 90% occur between the upper and the lower boundaries and 5% exceed the upper boundary. This lower limit is called lower 5% exclusion value (5% EV). The usual practice in establishing allowable strength is to determine this stress, which excludes the lowest five percent of the population.

The estimated allowable stress (EAS) or design strength was calculated using the ASTM formula:

$$\text{EAS} = 5\%\ \text{EV}/2.10 = 4860/2.1 = 2314 \text{ psi.}$$

Similar calculations were made for the mean bending strength computed omitting the UBS values for samples 9 and 10. As will be noted, samples 9 and 10 broke at very low values. Subsequent examination indicated that there was an inadequate curing of the resin in these specimens. Thus, for some comparisons as made below, these two specimens were excluded as being non-representative. The remaining sixteen specimens had a mean bending strength of 8054 psi.

The results for the reinforced specimens were compared to data obtained from a Western Wood Products Association (WWPA) survey on the stress capacity of non-reinforced grade-run No. 2 Douglas fir 2×4's and to standards for such 2×4's established under WWPA Lumber Grading Rules (1981). The data for the WWPA survey came from a carefully conducted study of in-grade lumber properties designed in consultation with the U.S. Forest Products Laboratory. This study utilized a 440 piece sample.

Because similar WWPA survey results are unobtainable for No. 1 Douglas fir and Select Structural Douglas fir, the results were also compared to survey results for No. 1 and select Douglas fir contained in a Forest Products Laboratory Research Paper dated June, 1983, entitled "Characterizing the Properties of 2-inch Softwood Dimension Lumber with Regressions and Probability" by William L. Galligan, Robert J. Hoyle, Roy F. Pellerin, James H. Haskell and James W. Taylor (not yet in published form). Table II shows the results from these tests as compared with the results from the WWPA survey and with the values derived from the WWPA estimated allowable stress for No. 2 Douglas fir, and with the results of the Forest Products Laboratory Research Paper.

TABLE II

| | | | Comparison for 2 × 4's | | | |
|---|---|---|---|---|---|---|
| | For 18 Reinforced No. 2 Douglas Fir 2 × 4's | For 16 Selected Reinforced No. 2 Douglas Fir 2 × 4's | WWPA Survey Results for No. 2 Douglas Fir 2 × 4's | WWPA Rules for No. 2 Douglas Fir 2 × 4's | Forest Prods. Lab Research Paper Info for No. 1 Douglas Fir 2 × 4's | Forest Prods. Lab Research Paper Info for Select Structural Douglas Fir 2 × 4's |
| Mean Bending Strength (psi) | 7620 | 8024 | 6300 | 6233* | 7523 | 7953 |
| Standard Deviation (psi) | 1616 | 1178 | 2001 | 1932* | 2332 | 2008 |
| 5% Exclusion (psi) Value | 4808 | 5963 | 2998* | 3045* | 3674 | 3313 |
| Estimated Allowable Stress (psi) | 2290 | 2839 | 1428 | 1450 | 1750 | 2100 |

*Calculated using a "t" coefficient = 1.65

The WWPA Rules specify, as indicated in Table II, an estimated allowable stress of 1450 psi for No. 2 grade Douglas fir. By calculation, the 5% EV=2.1×1450=3045 psi. Assuming a coefficient of variation=0.31, (i.e., s=0.31X), the calculated mean bending strength, $\overline{X}$, can be calculated as follows:

$\overline{X}-0.31\overline{X}t=5\%$ EV=3045 psi $\overline{X}-0.31\overline{X}(1.65)=3045$ psi X=6233 psi In some of the selected sixteen specimens there was evidence of some slippage between the rod and the 2×4 indicating an incomplete resin cure in these also so that it is possible they failed at a lower load than if there had been no slippage. Even so, the mean or average ultimate bending strength of 8,024 psi for the representative sixteen specimens compares with a mean bending strength of 6,300 psi for the samples in the WWPA survey. Thus, these sixteen specimens reinforced in accordance with the invention exhibited a mean bending strength twenty-seven percent greater than the average of the WWPA tests. The ultimate bending strength of these same specimens surpassed that of No. 1 and Select Structural Douglas fir as shown in the Forest Products Laboratory research paper.

Even including test specimens 9 and 10, the mean bending strength for all eighteen specimens was 7,620 psi, or twenty-one percent greater than the WWPA survey average, and twenty-two percent greater than the calculated mean strength under the WWPA Rules.

Moreover, the tests indicated that the reinforced 2×4's of the invention have substantially less deviation in strength. The tests indicated that, using the values of the sixteen members mentioned above, the standard deviation was 1178 psi. In the WWPA survey, the deviation was 2001 psi. Thus, the deviation of these sixteen test members was fifty-nine percent of the standard deviation found in the 440 2×4's tested in the WWPA survey. Even with the two lowest members included, the standard deviation for all eighteen members was 1616 psi, or about eighty-one percent of the WWPA survey average. For the sixteen selected reinforced pieces, the standard deviations are fifty-one percent and fifty-nine percent, respectively, of those for No. 1 and Select Structural Douglas Fir as disclosed in the Forest Products Laboratory research paper.

The 5% EV/2.1 value (estimated allowable stress) for the sixteen members was 2,839. For the eighteen, it was 2,290. These are about ninety-nine percent and sixty percent larger, respectively, than the WWPA Rule Book value of 1,450 psi. In fact, these values exceed the WWPA Grade Rule values of 1,750 psi for No. 1 2×4's by sixty-two and thirty-one percent, respectively, and the WWPA Grade Rule value of 2,100 psi for select structural by thirty-five percent and nine percent, respectively.

In summary, the sixteen specimens reinforced in accordance with the invention not only appreciably increase the mean bending strength for No. 2 Douglas fir shown by the WWPA survey, but also surpass that of No. 1 and Select Structural Douglas fir, at the same time showing markedly less standard deviation than No. 2, No. 1 and Select Structural Douglas fir, and widely surpassing the estimated allowable stress of all three grades. In essence, the invention brings about this result; that No. 2 lumber reinforced in accordance with the invention outperforms not only unreinforced No. 2, but also No. 1 and Select Structural grades, permitting significant upgrades in the utility of lumber.

EXAMPLE II

Five No. 2 grade 2×8 Douglas fir planks twelve feet in length selected at random from a larger lot were reinforced along one edge in the same manner as the 2×4's of Example I with a ¼" diameter pultruded glass fiber rod extending the full length of the plank. These planks were tested on a 135" span, the 2×8's being positioned with the reinforced edge facing downward, with the test load applied at third points, the load rate again being 0.5 inches per minute. Table III shows the results of these tests compared to the WWPA survey on 390 Douglas fir 2×8's and the WWPA Rule Book value for No. 2 Douglas fir 2×8's. In addition, the table includes data from the aforementioned Forest Products Laboratory survey.

TABLE III

| | Comparison for 2 × 8's | | | | |
|---|---|---|---|---|---|
| | For 5 Reinforced No. 2 Douglas Fir 2 × 8's | WWPA Survey Results for No. 2 Douglas Fir 2 × 8's | WWPA Rules for No. 2 Douglas Fir 2 × 8's | Forest Prods. Lab Research Paper Info for No. 1 Douglas Fir 2 × 8's | Forest Prods. Lab Research Paper Info for Select Structural Douglas Fir 2 × 8's |
| Mean Bending Strength (psi) | 6872 | 5594 | 5374* | 7456 | 8008 |
| Standard Deviation (psi) | 1721 | 2390 | 1665* | 2609 | 2566 |
| 5% Exclusion Value (psi) | 3396 | 1663 | 2625* | 3550 | 3814 |
| Estimated Allowable Stress (psi) | 1527 | 792 | 1250 | 1500 | 1800 |

*Coefficient of variation assumed = 0.31

The mean bending strength of these tested specimens exceeded the average ultimate strength of the WWPA survey specimens by twenty-three percent. The standard deviation of 1721 psi was twenty-eight percent less than that for the WWPA survey for No. 2 Douglas fir, and sixty-six percent and sixty-seven percent, respectively, of the standard deviation for No. 1 and Select Structure Douglas fir. The 5% exclusion value was computed using a "Student's 't'" coefficient of 2.13 because of the small sample size. The WWPA survey used a coefficient of 1.65 because of the larger sample. Based on these calculations, the estimated allowable stress exceeded the WWPA survey results by 193 percent (1527 vs. 792) and the WWPA Rule Book value by twenty-nine percent (1527 vs. 1250), surpassing also the estimated allowable stress for No. 1 Douglas fir.

As was the case with 2×4 Douglas fir, the reinforcement comprising the invention materially enhances the structural character of No. 2's and produces favorable comparisons with the superior No. 1 and Select Structural grades.

The data tabulated in Table II is set forth graphically in FIG. 9. The substantial improvement in the strength of 2×4's reinforced in accordance with the invention is readily apparent. The top of the cross-hatched portion indicates the allowable stress, the top of the stippled portion the 5% EV values, and the top of each bar the mean bending strength.

These tests show that practice of the invention can significantly improve structural wood members. Not only can the invention significantly improve the ultimate strength of wood structural members, but it also reduces significantly the variability of the strength in such members. These improvements have the effect of upgrading the reinforced members enabling the members to be used under higher design loads than for non-reinforced members. It also enables the use of lower grade stock to attain members of a desired level of strength. The reduction in deviation permits design of structures to closer load tolerance. The economic significance of these advantages is clearly apparent and it is achieved utilizing a relatively inexpensive glass fiber-resin rod secured relatively inexpensively to the wooden member.

The reinforcing rods may be positioned in both the top and bottom surfaces of a member and likewise could be utilized in the tension or compression edges of glued-laminated beams.

While only a few embodiments of the present invention have been shown and described, it will be apparent many changes and modifications can be made hereto without departing from the spirit and scope of the invention.

We claim:

1. A composite integral structural support member adapted to be cut to the desired length, if necessary, and incorporated into a load bearing structure for the purpose of accepting at least a portion of the load imposed upon such structure, said member comprising a wooden beam, a groove of predetermined depth longitudinally disposed within a surface of said wooden beam, and an unstressed nonwood, nonmetallic reinforcing rod adhesively fixed within said groove whereby said support member has an ultimate strength greater than that of said wooden beam.

2. The structural support member of claim 1 wherein the surface of said reinforcement rod is abraded.

3. The structural support member of claim 1 wherein the exposed surfaces of said rod, after affixation, are no higher than the plane formed by adjacent surfaces of said wooden beam.

4. A reinforced structural support member comprising a wooden beam, a groove of predetermined depth longitudinally disposed within a surface of said wooden beam, and an unstressed reinforcing rod of glass fibers bonded with a polyester resin adhesively affixed within said groove.

5. The structural support member of claim 4 wherein said rod is circular in cross-section and said groove is formed with a complementarily-shaped bottom surface.

6. The structural support member of claim 4 wherein said reinforcement rod and said groove each are of generally triangular cross-sectional configuration.

7. The structural member of claim 4 wherein said reinforcement rod has a bull-nosed cross-sectional configuration, and said groove is of complementary cross-section.

8. The structural support member of claim 7 wherein the exposed surface of said reinforcement rod is substantially coplanar with the adjacent surfaces of said wooden beam.

9. A structural support member as in claim 4 wherein said wooden beam is a single wooden piece.

10. A structural support member as in claim 4 wherein said wooden beam comprises wood flakes bonded by a resin.

11. A structural support member as in claim 4 wherein said wooden beam is laminated from smaller wood pieces.

12. A reinforced structural support member comprising a wooden beam, a groove of predetermined depth longitudinally disposed within a surface of said wooden beam, a plurality of holes in the bottom of said groove, and an unstressed reinforcing rod adhesively affixed within said groove.

13. A reinforced structural support member comprising a wooden beam, a groove of predetermined depth longitudinally disposed within a surface of said wooden beam, a plurality of notches in the wall of said groove extending in a direction transverse to the longitudinal axis of said groove, and an unstressed reinforcing rod adhesively affixed within said groove.

* * * * *